United States Patent [19]

Grace

[11] 4,444,514

[45] Apr. 24, 1984

[54] DEVICE TO PERMIT REPRODUCING OR PLAYER PIANOS TO SERVE AS MUSICAL CLOCKS

[75] Inventor: F. Cecil Grace, New York, N.Y.

[73] Assignee: LYF Electronics Inc., New York, N.Y.

[21] Appl. No.: 314,663

[22] Filed: Oct. 23, 1981

[51] Int. Cl.[3] ..... G04B 21/00

[52] U.S. Cl. ..... 368/273; 368/10; 84/13; 84/112

[58] Field of Search ..... 368/273; 84/13, 112–115; 200/32 D, 32 DA, 61.72, 61.62, 61.7

[56] References Cited

U.S. PATENT DOCUMENTS

| | | | |
|---|---|---|---|
| 2,835,771 | 5/1958 | Rausch | 200/61.62 |
| 3,803,375 | 4/1974 | Foltz | 200/61.7 |
| 4,336,737 | 6/1982 | Pomber | 84/115 |

FOREIGN PATENT DOCUMENTS

| | | | |
|---|---|---|---|
| 2803078 | 7/1979 | Fed. Rep. of Germany | 84/115 |

*Primary Examiner*—Bernard Roskoski

*Attorney, Agent, or Firm*—Robert C. Schmertz, Jr.

[57] ABSTRACT

An apparatus for adapting an electric player piano to play the hours, simulating the chimes of a clock, can be attached to the piano without alterations to the piano of a permanent nature. The apparatus includes a clock for actuating the piano on each hour and a switch responsive to actuation of a predetermined note by the piano for producing a control signal for turning the piano off. A second switch, responding to actuation of a second predetermined note, produces a signal for suppressing striking of the hour during the night. A sensor block carrying one or more switches may be placed upon the keyboard for detecting depression of corresponding keys. In addition, a key may be maintained in a partially depressed condition to prevent its sounding when it is used to produce a chime control signal.

8 Claims, 8 Drawing Figures

DEVICE TO PERMIT REPRODUCING OR PLAYER PIANOS TO SERVE AS MUSICAL CLOCKS

BACKGROUND OF THE INVENTION

This invention relates to apparatus for enabling player and reproducing pianos to serve and to strike the hour as musical clocks. More particularly, this invention relates to such an apparatus for use on a player piano without physical alteration of the piano.

A reproducing piano is known which was originally engineered to strike the hours and play music before each strike, or after each strike, or both, thereby serving the same function as a musical clock. The reproducing piano had an apparatus which contained a synchronous clock motor; the piano was automatically started every hour on the hour, and, using the piano roll, would strike special chords. The chords sounded like chimes and additional music appropriate to each hour was played. The piano was operated by a specially fabricated perforated paper roll which had a long hole at the edge of the roll for shutting off the piano. The piano contained a special mechanism to distinguish this long hole from shorter holes placed at the same position on the roll for controlling expression, and to switch off the power. Pianos of this kind are available today, but only as antiques.

Many antique electric player and reproducing pianos exist today which do not have the built-in capabilities, described above, to respond to the special piano roll to strike the hour. The normal reproducing piano does not have the special mechanism, and the player piano does not have the tracker bar holes needed for controlling expression.

The purpose of the present invention is to make it possible for nearly any reproducing or electric player piano (both hereinafter referred to as player piano) to serve as a musical clock without significant structural alteration of the piano. In this way, permanent alteration of the piano which, in the case of antiques, would be likely to reduce the value of the instrument, is avoided.

SUMMARY OF THE INVENTION

According to the present invention, operation of a player piano under control of a special piano roll is started by a clock operated switch. The piano plays one or more notes or chords, sounding like chimes, to identify the hour. The piano may also play a tune. After a set of chimes is played to identify a particular hour, a predetermined tone signal on the special piano roll is detected and a predetermined piano key is actuated. Actuation of the piano key is detected by a sensor and a signal from the sensor turns the piano off. In a preferred embodiment, the sensor is a switch which is carried in a sensor block. The block is placed on the keyboard of the piano so that an actuating arm on the switch contacts the predetermined piano key. When that key is actuated by the predetermined tone signal, the key falls and the switch is closed. The closing of the switch produces a control signal for turning the piano off.

The roll which controls playing of the hours by the piano is specially made for the purpose and contains tone signal holes for controlling the striking of chimes on the piano. Particular combinations of tones, "striking" the hour, are prerecorded sequentially in groups. A predetermined tone signal for stopping operation of the piano until the next hour is to be struck is recorded between successive groups of tone signal holes.

Alternative embodiments of the invention provide other forms of sensors. For example, the pneumatic system of the piano can be modified without impairing the value of the piano as an antique by inserting a T-joint in the hose which couples air to the pneumatic of the predetermined piano key from the associated tracker bar opening. A pneumatically operated switch attached to the T-joint responds to the changes in air pressure. In still another embodiment, the signal for turning off the piano is derived from a switch which is actuated by the mechanical action which drives the predetermined piano key; the switch may respond, for example, to motion of the pneumatic.

According to another feature of the invention, detection of a second predetermined tone signal on the recording, which occurs at the same time as the first predetermined tone signal, controls silencing of the piano during the night. A second clock-activated switch causes the piano to resume playing the hours at a predetermined time.

While described in the environment of a player piano, it will be understood that the principles of the invention can be applied to the control of other musical instruments which are operated by a recording.

DETAILED DESCRIPTION OF THE INVENTION

Figure 1:
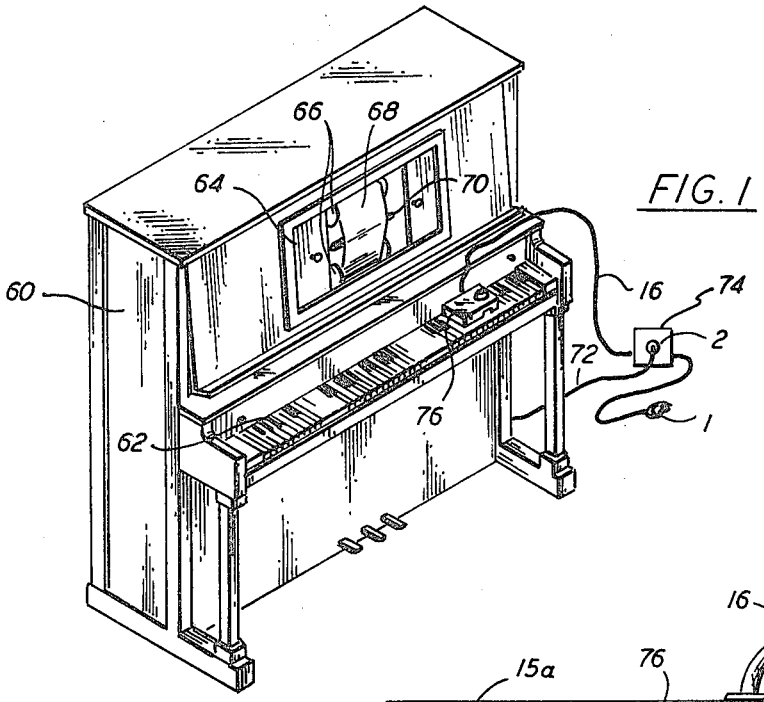
FIG. 1 is a view of a player piano, adapted for striking the hour in accordance with the present invention.
Figure 2:
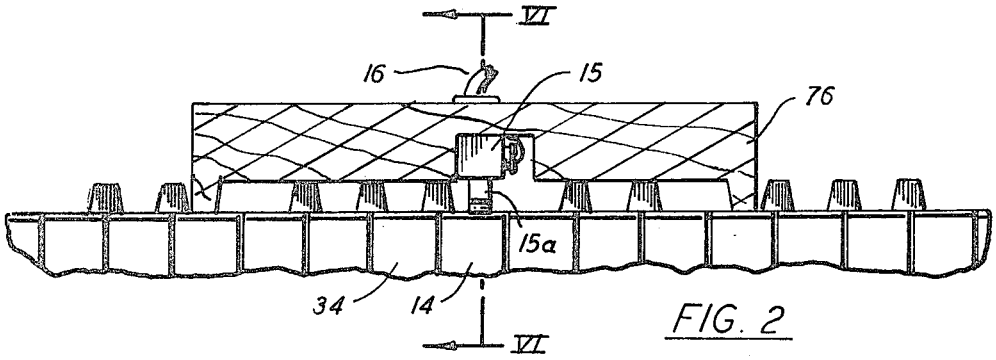
FIG. 2 is a close-up view of the keyboard of FIG. 1 showing the removable sensor in position.

FIGS. 1 and 2 show a player (or reproducing) piano 60 adapted for striking the hour. Player piano 60 has keyboard 62, doors 64, within which paper 68 from a piano roll passes between spools 66 on the player mechanism, and a drive for causing paper 68 to pass over tracker bar 70. Player piano 60 includes a pump driven by an electric motor (not shown) for supplying vacuum to the tracker bar and to the piano's pneumatic actuators, and may also include an electric motor, if one is used in place of an air-motor, for driving the rolls. Power is supplied to the piano by means of power cord 72 which is plugged into outlet 2 on control unit 74. Removable block 76, placed on keyboard 62 and connected to control unit 74 by cable 16, contains one or more switches, each of which is responsive to the position of a piano key and each of which is connected to control unit 74 for operating the piano.

Figure 3:
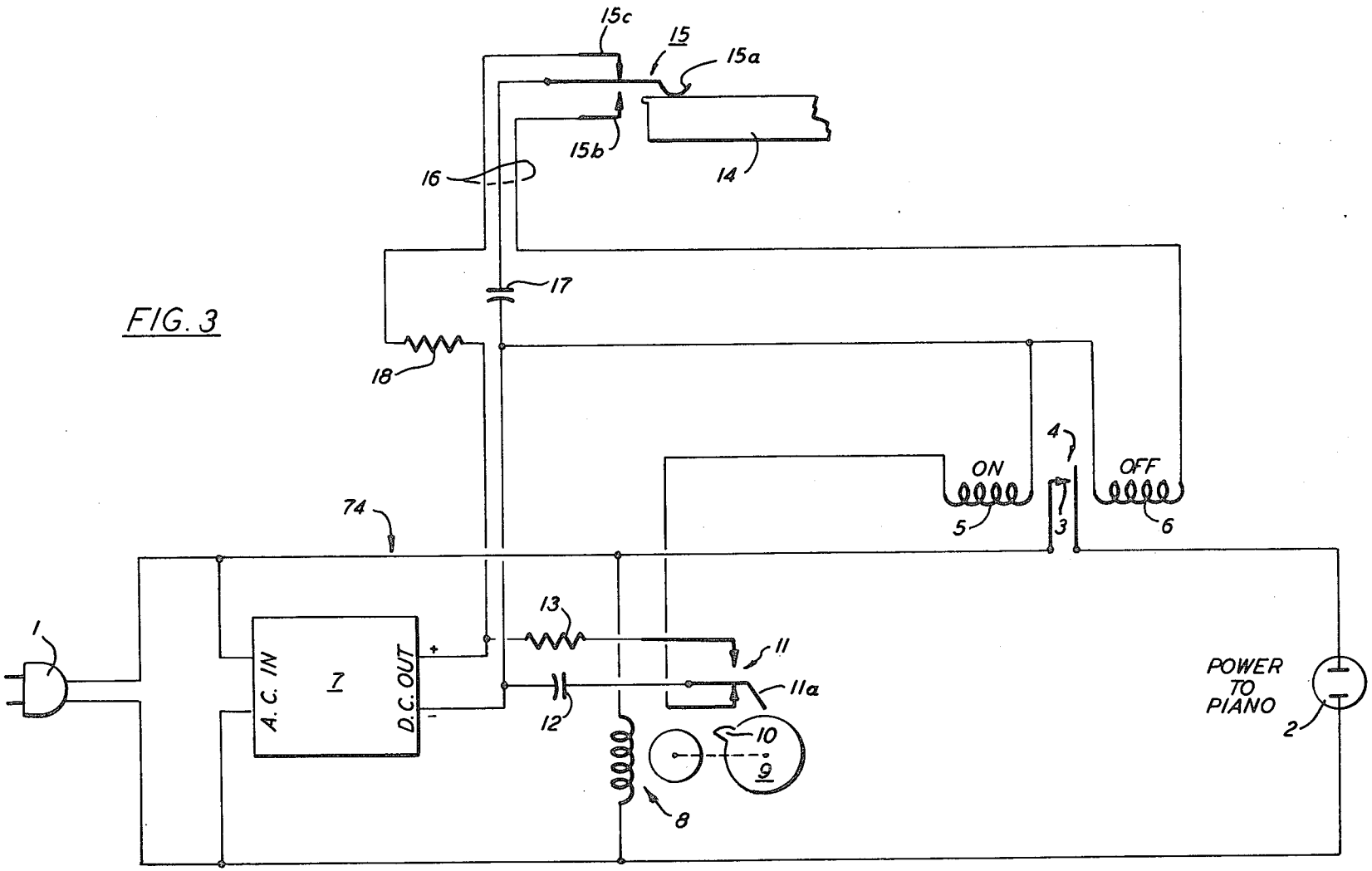
FIG. 3 is a schematic diagram of a basic circuit for use in practicing the invention.

FIG. 3 is a schematic diagram of a circuit useful in control unit 74 for controlling a piano according to the invention. A power cord, equipped with plug 1 for insertion into the power mains, is connected to power receptacle 2 for piano power cord 72, via a pair of wires, one of which passes through contacts 3 of latching relay 4. Relay 4 is controlled by a latching, or "on", coil 5 and a releasing, or "off", coil 6. This relay has low voltage DC coils. Transformer-rectifier unit 7, which receives its power from input plug 1, provides the required voltage in the coils.

Timing of the chime action is regulated by synchronous motor 8 which rotates cam 9 once-per-hour. Just before each hour, projection 10 on cam 9 lifts actuator 11*a* of switch 11, transferring the switch contacts and causing capacitor 12 to be charged by low voltage supply 7 through current limiting resistor 13. It is to be understood that intervals other than the hour can be used, such as the fifteeen minute intervals needed to imitate Big Ben chimes.

Just at the hour, projection 10 of cam 9 clears actuator 11*a* of switch 11, allowing it to return instantly to its original position. The switch contacts transfer, connecting the now fully charged capacitor 12 to provide an "on" signal to coil 5 of relay 4, causing it to close relay contacts 3. This connects AC voltage to plug 2 and starts the piano. The piano roll is programmed in advance to strike the hour and to play any music that may also have been recorded. When this is concluded, a switch-off hole in paper 68 of the piano roll signals for playing the predetermined control note reserved for the switch-off function.

Figure 6:
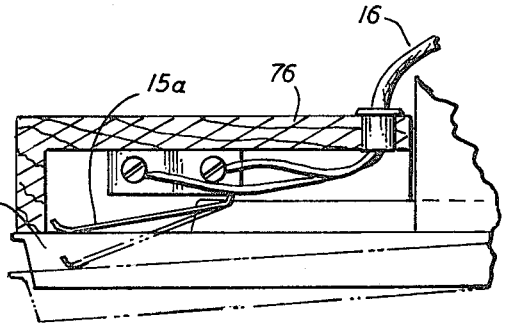
FIG. 6 is a side view in partial cross-section of the sensor block of FIG. 2, showing a sensory switch in position on a piano key.

FIGS. 2 and 6 show end and side views, respectively, of a piano key 14 arbitrarily chosen as the switch-off note. The drawing shows a white key, but a black key could just as well be used. Actuator 15*a* of sensor switch 15 rests on key 14. Switch 15 may be a microswitch. Key 14 normally holds actuator 15*a* in the "up" position. The contacts of switch 15 are connected to power switching unit 74 by flexible cable 16.

A capacitor 17 (FIG. 3) is connected in series with "off" coil 6 of relay 4 via contact arm 15*a* and contact 15*b* of switch 15. Capacitor 17 is kept charged from low voltage supply 7 through current limiting resistor 18 and contact 15*c* on switch 15. Contact 15*a* is transferred to connect with contact 15*c* when key 14 is up. When an appropriately placed control hole in piano roll 68 passes the tracker bar 70 (FIG. 1), key 14 drops and the contacts of switch 15 transfer. Capacitor 17 is thereby connected to, and discharges through, "off" coil 6 of the relay, opening contacts 3 and stopping the piano. Meanwhile, provided that it is made short enough, the control hole will have moved away from tracker bar 70 before the paper stops moving, leaving the piano ready to be activated again by the motor driver cam.

Naturally the note used to switch the instrument will be sounded when its pneumatic is activated by the control hole. However this should not be objectionable if a slight pause is allowed between the end of the music and the sounding of the note, and if, in the case of reproducing pianos, the note is sounded at minimum intensity and with the soft pedal on. Also, with most pianos it will be possible to use the arrangement of FIG. 7 for suppressing or reducing the sound.

Figure 4:
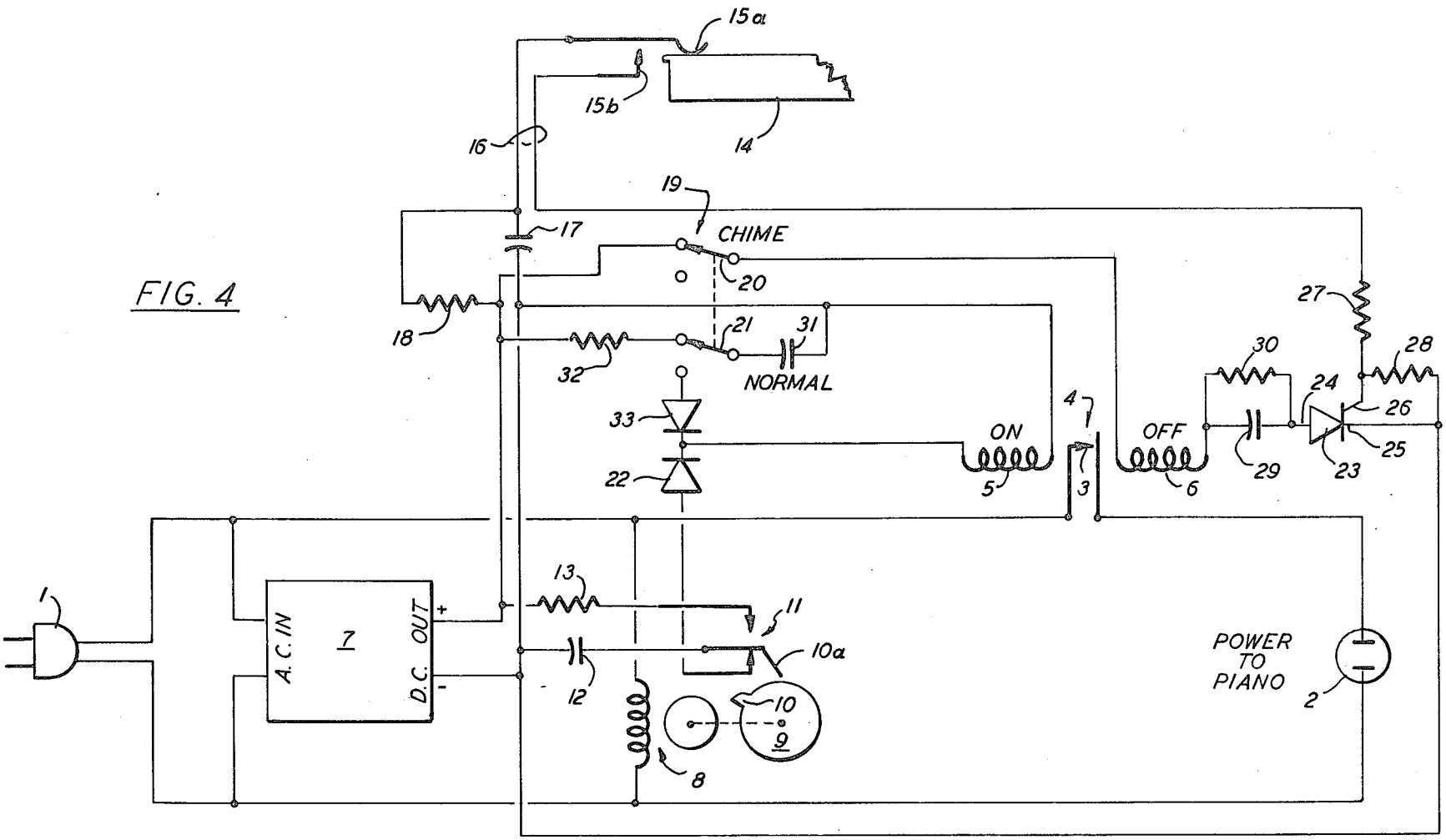
FIG. 4 is a schematic diagram of a circuit, like that of FIG. 3, but in which sensitive switches are relieved of heavy currents.

FIG. 4 shows an embodiment of the invention in which the contacts of switch 15 are relieved of the currend load needed to operate relay 4. FIG. 4 also includes a switch 19 for disabling the chime when its operation is not desired. Parts which serve the same function in FIG. 3 as FIG. 4 have the same number in both figures.

Switch 19 has two poles 20 and 21 which occupy two positions, marked CHIME and NORMAL. When the switch is thrown to the CHIME position and the special roll is used, the piano will serve as a musical clock as described herein. When switch 19 is thrown to NORMAL, the piano may be operated in the usual way, playing other rolls and, even if the contact assembly containing switch 15 is allowed to remain on the keyboard, the piano will not turn off when the note selected for the turn-off function is encountered in normal music.

The operation of starting the piano on the hour is the same as it was in FIG. 3, except that the current from capacitor 12 for operating coil 5 of relay 4 now flows through diode 22 and that contact 15*a* of keyboard switch 15 has been eliminated.

The operation of stopping the piano, still by pulsing "off" coil 6 of relay 4 to open contacts 3, is controlled in FIG. 4 by SCR (silicon controlled rectifier) 23. SCR 23 has an anode 24, a cathode 25, and a gate electrode 26. Gate electrode 26 is activated by keyboard switch 15 as follows. Capacitor 17 is kept continuously charged through current limiting resistor 18. When the control note is played and key 14 drops, capacitor 17 is connected, via switch contact 15*b* and via gate current limiting resistor 27, to gate 26 of SCR 23, causing the latter to trigger. Once it has triggered, capacitor 17, which can be much smaller than the corresponding capacitor of FIG. 2, continues to discharge through series-connected voltage-dividing resistors 27 and 28. Resistor 27 has a large value to limit the gate current to the small amount needed for triggering. Resistor 18, through which capacitor 17 charges, is also made large so that switch 15 has to switch very little current. In this way the electrical life of the switch can be made to approach its mechanical life. Note, also, that very little energy is consumed by the charging of capacitor 17 when the key is down or the block is off of the keyboard.

Anode 24 of SCR 23 is returned to the positive terminal of low voltage supply 7 via series-connected capacitor 29, which is shunted by resistor 30, via release coil 6 of relay 4, and via pole 20 of switch 19. Pole 20 is closed when the chime effect is in use. Since capacitor 29 has no initial charge, the output voltage of DC supply 7, minus the small drop in SCR 23, is applied to "off" coil 6 when SCR 23 triggers. The current then gradually diminishes as capacitor 29 charges. Capacitor 29 is made large so that the flow of charging current does not substantially diminish before the "off" coil has had time to act, releasing contacts 3 and stopping the piano. After that, the current continues to decrease, and, if SCR 23 were to continue to conduct, would eventually reach a terminal level determined principally by shunting resistor 30. However, resistor 30 is made large enough that this terminal current is less than the holding current of SCR 23. As soon as the current reaches a value which is less than the holding current, the SCR reverts to its blocking state, and the current is cut off completely. Capacitor 29 then discharges through resistor 30, and the circuit is ready to be used again.

Since the current for release coil 6 of relay 4 passes through pole 20 of CHIME-NORMAL switch 19, and since pole 20 is open when switch 19 is in the NORMAL position, it follows that, in normal use of the piano, relay 4 can never be released to stop the piano, even when sensor block 64 is left on the keyboard and the note corresponding to key 14 is sounded in the course of playing a regular roll. However, it is more likely than not that contact 3 of relay 4 will already be open at the time the switch is thrown from CHIME to NORMAL. If that is the case, relay 4 must be operated when switch 19 is thrown. To effect this, provision is made to pulse operating coil 5 every time switch 19 is thrown from CHIME to NORMAL. If contacts 3 are already closed, this will have no effect, but if they are open it will close them.

For this purpose, then operating coil 5 is pulsed by pole 21 of switch 19 every time switch 19 is thrown to NORMAL. When switch 21 is in the CHIME position, capacitor 31 is charged from the DC voltage supply through current limiting resistor 32. Then, when switch 19 is thrown to NORMAL, pole 21 connects charged capacitor 31 to operating coil 5 via diode 33, giving the necessary impulse.

Diode 22 is connected in the path between switch 11 and operating coil 5 to keep a damaging current surge from flowing into capacitor 12 if switch 19 should be thrown from CHIME to NORMAL at a time when the projection 10 of cam 9 was not lifting the actuator of switch 11. In this case, charged capacitor 31 would be connected to discharged capacitor 12 without any current limiting resistors being in the path. Also, if the two capacitors were of equal value, the final voltage after this discharge would only be half the supply voltage, which might not be enough to operate relay 4. Diode 33 is required for a similar reason. Even with switch 19 in the NORMAL position, capacitor 12 is charged and connected to operating coil 5 once each hour. Without diode 33, charged capacitor 12 would be connected to the discharged capacitor 31 each hour without any current limiting resistor in the path, and excessive currents would flow.

Figure 5:
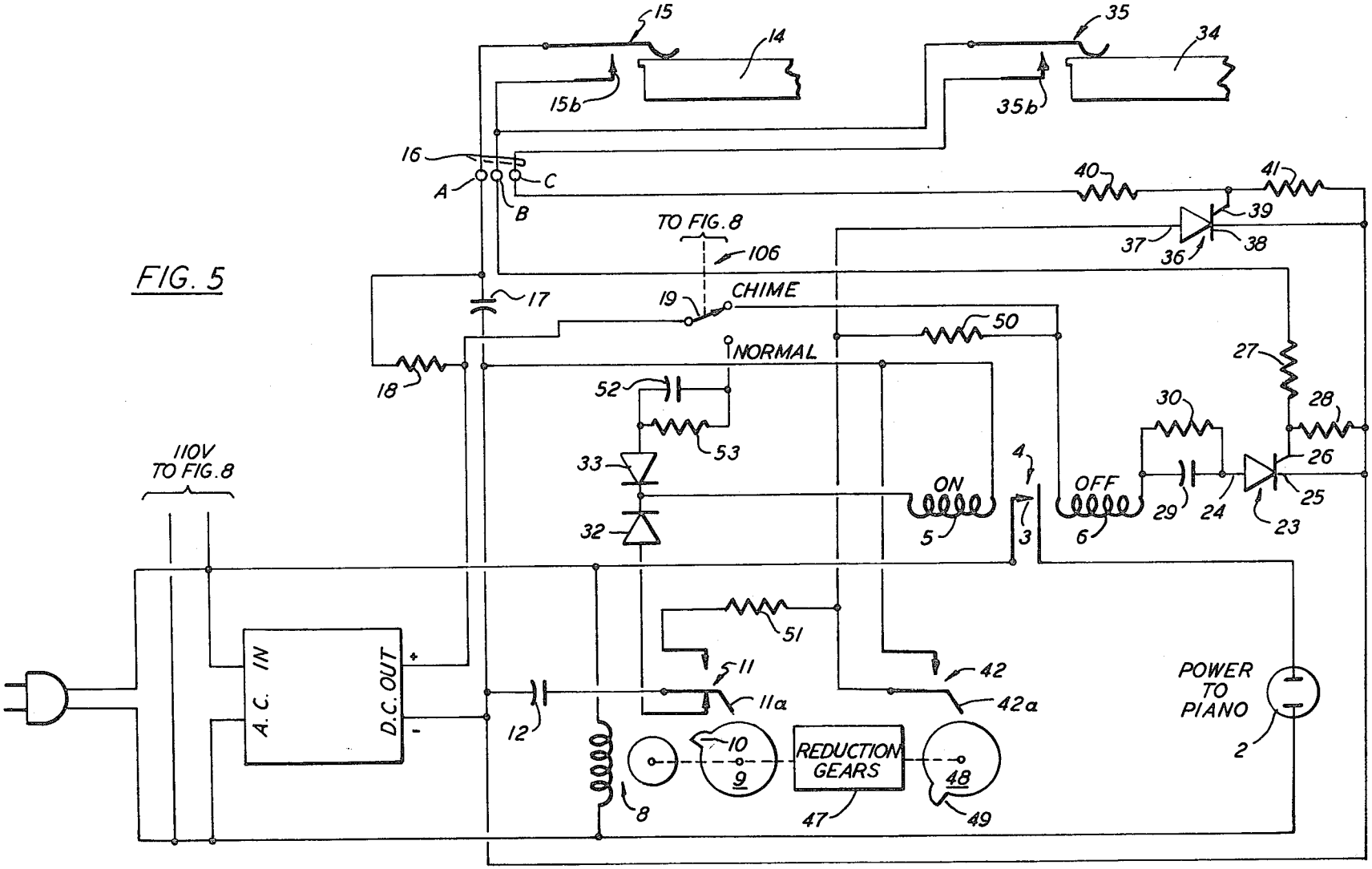
FIG. 5 is a schematic diagram illustrating a circuit for disabling the striking of the hour during the night.

It may be desired that the piano not strike or play during the hours when most people are asleep. FIG. 5 shows an embodiment of the invention which accomplishes this purpose. In FIG. 5, parts which were used in the previously described figures carry the same number. In the description which follows, it is assumed that the piano is to strike for the first time each day at 7 A.M. and for the last time at 10 P.M., although other times could obviously be chosen.

After the 10 P.M. strike and any music selection are played, the last switch-off control hole is omitted from the roll so that the switch-off note does not sound. The roll proceeds to the rewind hole which is found, as usual, at the end of most piano rolls, and the roll rewinds. It will be understood by those skilled in the art that pianos are caused to repeat by activating a spoon valve or by the passage of air through a hole in the take-up spool when the end of the roll is reached. When the beginning of the roll is reached and, if the piano has been put in the "repeat" mode, the piano switches back to "play", and starts in the normal manner. The roll again moves forward, and very soon two holes are encountered which sound two predetermined notes and depress two keys simultaneously. One of the keys which goes down is key 14, the same one previously used, and switch 15 is activated, as previously explained. The other key is key 34, which normally holds up the actuator of switch 35 and keeps its contact open. An additional conductor is provided in cable 16 to accomodate the additional circuitry. Switch 35 may conveniently be placed next to switch 14 in removable block 76 and key 34 may thus be next to key 14. (FIG. 2) Both switches may be single-throw switches as shown in FIG. 5.

"Night" control SCR 36, has been added to the circuit. SCR 36 has anode 37, cathode 38, and gate 39 which is triggered by concurrent action of switches 15 and 35. When switches 15 and 35 are closed simultaneously, current from charged capacitor 17 flows in through switch contact 15*b* (as in FIG. 4) to trigger SCR 23 by passing current through resistor 27 into SCR gate 26. This stops the piano. In addition, energy from capacitor 17 (which has been charged through resistor 18), flows from contact 15*b*, through switch contact 35*b* and gate current limiting resistor 40 into gate lead 39 to trigger SCR 36. The triggering of SCR 36 signals the system that the piano is not to start again until 7 o'clock the next morning.

When SCR 36 is not in its conducting state, operation of the circuit of FIG. 5 is the same as the circuit of FIG. 2 except that, when actuator 11*a* of switch 11 is raised by projection 10 on cam 9, the path for charging capacitor 12 is now through the series circuit of CHIME-NORMAL switch 19 (which now has only one pole), resistor 50, resistor 51, and, of course, switch 11.

After the 10 o'clock strike, the playing of any selection provided for, and the rewinding or the piano roll, both SCR's are triggered as explained above, and the piano is stopped. SCR 36 draws its anode supply from power supply 7 via CHIME-NORMAL switch 19 and resistor 50. Resistor 50 is chosen so that the current through it exceeds the holding current of SCR 36, causing SCR 36 to remain conducting. The voltage at the junction of resistors 50 and 51 is then the on-state anode voltage of SCR 36 which is a very low value. When projection 10 on cam 9 raises actuator 11*a* of switch 11, capacitor 12 will charge only to this value which is insufficient to operate relay 4 when switch 11 transfers back at the hour. Thus the piano does not start at 11 o'clock, nor at 12 o'clock, etc.

In this embodiment of the invention, a reduction gearset 47 is added to the mechanical assembly consisting of motor 8 and cam 9; it drives a second cam 48. Reduction gearset 47 conveniently has a ratio of 24 to 1, and, since cam 9 rotates once an hour, cam 48 rotates once a day.

Cam 48 has a projection 49 which operates actuator 4Za of switch 42, closing switch 42 at some time well before 7 A.M.—perhaps one or more hours before. Then, at some time near 6:30 A.M. (the timing can be off by nearly half an hour either way), switch 42 reopens.

Switch 42 is connected directly across SCR 36, from anode lead 37 to cathode lead 38. When switch 42 closes, SCR 36 is deprived of voltage, and reverts to a non-conducting or blocking state. Switch 42 also relieves SCR 36 of its function of bringing the junction of resistors 50 and 51 to a low voltage—in this case to zero voltage. Therefore, if switch 42 closes more than an hour, or even several hours, before 7 A.M., the piano cannot be started by operation of cam 9 and switch 11 because capacitor 12 will not charge. However, when switch 42 reopens, this inhibition is removed, and the next time projection 10 on cam 9 clears actuator 11*a* of switch 11, e.g., at 7 A.M., the piano will start.

When CHIME - NORMAL switch 19 is thrown to NORMAL, the voltage is removed from "off" or release coil 6 of relay 4, so that operation of switch 15 will not stop the piano. At the same time, voltage is removed from SCR 36, which, if it was in a conducting state, now reverts to a blocking state. Also, relay 4 is closed, if it should be open when the switch is thrown. This is accomplished by applying voltage from power supply 7 through switch 19, capacitor 52, and diode 33, to operating coil 5 of relay 4. Since capacitor 52 is initially in a discharged condition, the voltage applied to coil 5 will be the supply voltage less the drop in diode 33. As capacitor 52 charges, this voltage will diminish, but capacitor 52 is made large enough to cause relay 4 to lock up before the voltage drops very much. Capacitor 52 is shunted by resistor 53 so that it will discharge and be ready for use again when switch 19 is thrown to CHIME. Of course, as long as the switch is thrown to NORMAL there will be some current through resistor 53 and coil 5 of relay 3, but this will be so small that it will not waste much power or cause the relay to overheat even if it should have coils which are rated for intermittent duty only.

This system of skipping the late night hours has the following advantages:

If, for any reason, the piano strikes incorrectly, it will correct itself automatically, since the 7 A.M. strike cannot be released at other than the correct time.

When the special roll is removed from the piano in order to play regular rolls, the special roll, when replaced, does not have to be played through to reach the time of day in order to revert to CHIME operation. With the apparatus of the present invention, it is only necessary to start the roll and let it stop when keys 14 and 34 come down, nothing else having been played. The piano will then begin striking at 7 A.M. next morning.

When daylight saving time arrives or standard time returns, it is only necessary to reset cam 48 to the new time at any time after 7 A.M. on the last day of the outgoing time. The piano will continue striking according to the old time on that day, and will strike according to the new time on the next day.

There is a saving of electricity since the pump of the piano is not started when it is not required to play.

Figure 7:
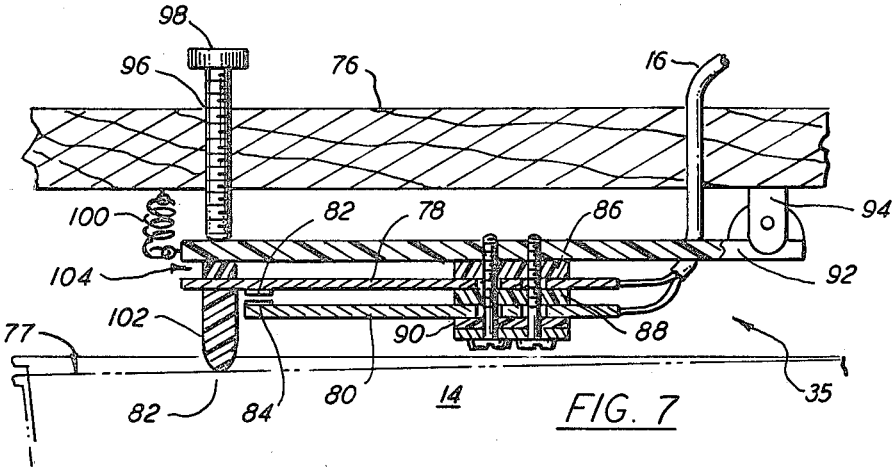
FIG. 7 is a side view, in partial cross-section, of a switch support and switch which together operate to maintain a piano key in partially depressed condition.

FIG. 7 illustrates a switch construction which is useful in the practice of the invention for providing control signals for operating the chimes without sounding of tone when key 14 is activated by the control hole in the roll. This sensor switch has upper leaf 78 and lower leaf 80 which carry mutually facing contacts 82 and 84, respectively. The contact leafs are supported and spaced by insulating blocks 86, 88, and 90, the assembly being conventionally fastened to switch support arm 92 by means of screws. Switch support arm 92 is pivoted at one end on pivot post 94. Pivot post 94 is, in turn, suspended on the inside of the cover portion of removable block 76. The switch assembly is supported above and generally parallel to the surface 77 of the piano key. Upward travel of the free end of switch carrier 92 is limited by means of adjusting screw 96 which is threaded into cover 76. Adjusting screw 96, which can be turned by adjusting knob 98, passes through support block 76 and rests against the top of switch carrier arm 92. Arm 92 is lifted and held against the free end of adjusting screw 96 by tension spring 100. The free end of spring leaf 78 projects beyond the free end of spring leaf 80 and carries a downward projecting nib 102 which rests against upper surface 77 of the piano key.

By adjustment of adjusting screw 96, key pad 104, carried on support arm 92, is brought to bear on the upper surface of spring leaf 78, and nib 102 presses the piano key down. At the same time, switch support arm 92 rotates, carrying with it the switch, with contacts 8Z and 84 in the open position. By adjustment of the screw, the piano key is pressed down just far enough so that, when the key is activated by the pneumatic, it cannot travel far enough to cause the note to sound, but still allowing enough travel to permit nib 102 to drop and to bring contacts 82 and 84 together when the piano key falls. It will be understood that, with the switch constructed in this manner, contacts 82 and 84 must be normally closed so that, when key 34 raises upper leaf 78, the switch is opened.

The switch illustrated in FIG. 7 is intended for use with the circuits of FIG. 4 and FIG. 5, where it would serve as switch 15 on key 14. It will be understood that it need not be used on key 34, since the system will not respond when only key 34 is played—key 34 is therefore free for use in playing music. It will also be understood that the switch can be adapted for use with the circuit of FIG. 3 by providing it with the necessary double throw structure.

Figure 8:
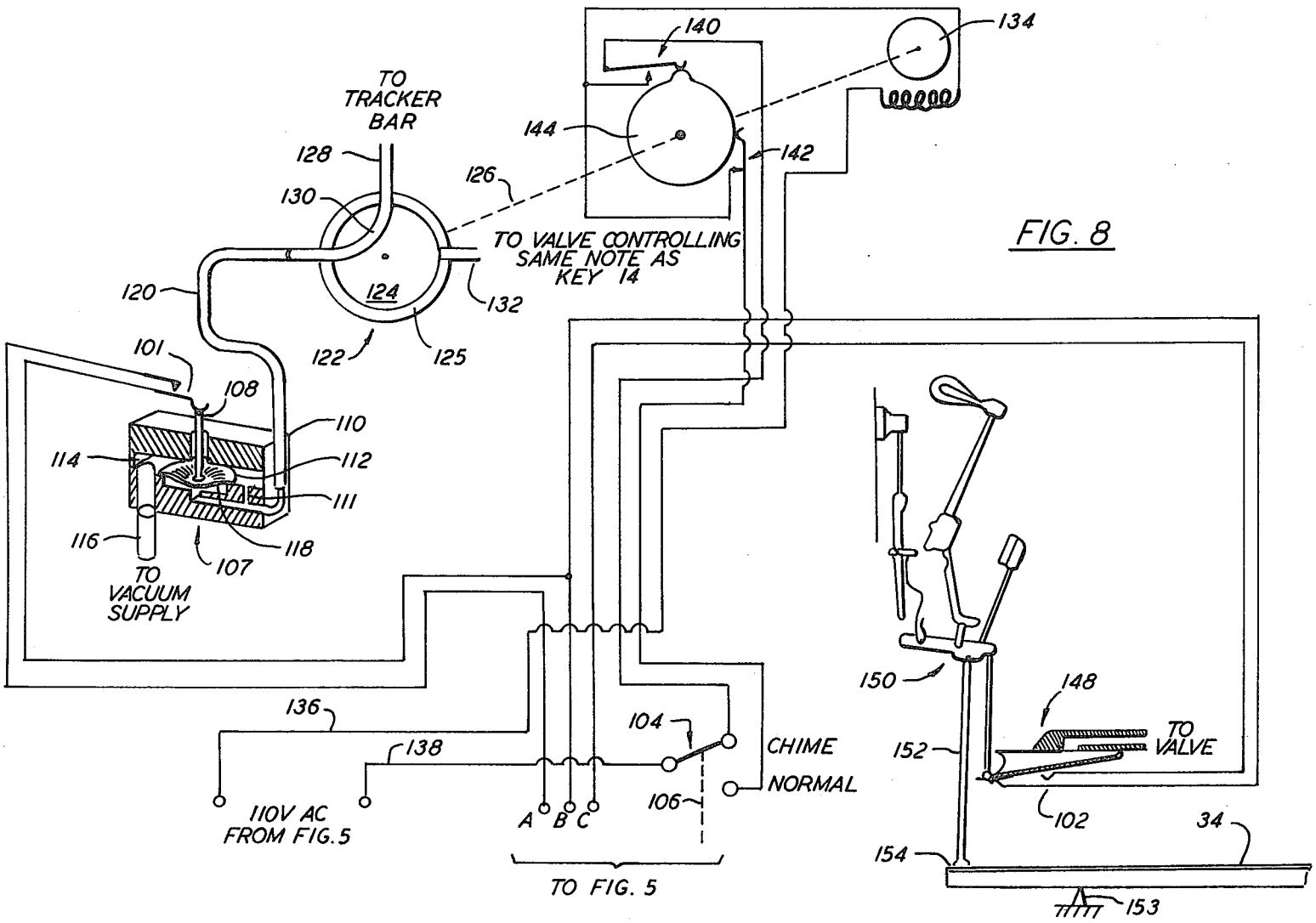
FIG. 8 is a schematic diagram of pressure-sensitive sensor mounted in a tube connecting a hole in a tracker bar to the pneumatic of a piano key.

FIG. 8 shows embodiments of the invention in which, instead of depending upon the placement of sensor block 76 upon the piano keyboard 62, a control signal for operating the chimes is derived, in one case, from variation in pressure in the tube connecting the tracker bar with the pneumatic for operating the piano key which is used as a control signal source and, in another case, from motion of the pneumatic attached to the action of the predetermined piano key. Since in the first case, a substitute tube or, more simply, an extrusion can be used, the integrity of the piano as an antique can be preserved. In the second case, the physical structure of the piano need not be altered at all.

The circuitry of FIG. 8 is intended for interconnection with that of FIG. 5 in place of switches 15 and 35, e.g. the switches actuated by the surfaces of piano keys 14 and 34. To this end, the connections which formerly connected switches 15 and 35 to the lower part of FIG. 5 are opened at points A, B and C, (near the top of FIG. 5), and tracker-activated control switch 101 and pneumatic-operated control switch 102 are connected in their respective places. Tracker-operated switch 101 is connected to terminals A and B and pneumatic-operated switch 102 is connected at points B and C. A second single-pole, double-throw switch section 104 is added to CHIME-NORMAL switch 19 and is ganged for operation with switch 19 as shown by dashed line 106.

Switches 101 and 102 of FIG. 8 now serve as control signal sources for the circuit of FIG. 5. Switch 101 is connected to pneumatic actuator 107, being actuated by rod 108 which passes into actuator 107 through an opening in the wall 110 of the actuator body. Rod 108 is connected to pouch 112 inside actuator 110. Pouch 112 forms a flexible common wall between upper chamber 114, which is connected by tube 116 to the vacuum supply (not shown), and to lower chamber 118. Bleed line 111 equalizes pressure on both sides of pouch 112 when line 120 is closed. Chamber 118 is connected via control valve 122 to tracker bar connecting tube 128. Control valve 122 is a two-way valve having rotor 124 which can be rotated through 360° in cylinder 125 by motor driven shaft 126. When rotor 124 is in one position, ports in the wall of cylinder 125 are aligned with rotor passage 130 to connect valve 107 to the tracker bar via tube 120. When rotor 124 is positioned 90° to the right of the position shown in FIG. 8, tracker bar connecting tube 128 is connected to the valve controlling the pneumatic of a predetermined note on the piano keyboard. The note chosen may be that used in the preceding illustrations.

Two-way valve drive shaft 126 is turned by electric motor 134 which receives its power from the AC source of FIG. 5 and which is controlled by CHIME-NORMAL switch 104 via connecting lines 136 and 138. The single pole of CHIME-NORMAL switch 104 is connected to line 138 and supplies electricity to the contact actuating arm of cam operated switch 140, when in the CHIME position, and to the contact actuating arm of cam operated switch 142, when in the NORMAL position. The other contacts of switches 140 and 142 are connected to each other and to motor 134. When switch 104 is in the CHIME position, power is connected to the motor via switch 140. When opened by action of cam 144, switch 140 interrupts the supply of electricity to motor 134 and stops it. When switch 104 is in the NORMAL position, rotor 124 is stopped at the other position by the opening of cam operated switch 142. CHIME-NORMAL switch 104 therefore controls either the activation of switch 101 by the pneumatic signal from the tracker bar or it enables the playing of the note as commanded by the signal from the tracker bar.

For the sake of brevity of illustration, FIG. 8 also illustrates another sensor for responding to the tone signal on the piano roll. This sensor is in the form of switch 102 which is coupled to and actuated by pneumatic 148. It is to be understood, however, that both sensor switches of FIG. 8 may be either pneumatically or mechanically actuated.

Switch 102, which is shown as a normally closed switch, is placed beneath pneumatic 148; pneumatic 148 is coupled to key 34 via the usual piano action 150. Motion of pneumatic 148 raises whippen 150, coupling lifting motion to move hammer 152 towards the associated piano strings. This is the normal behavior of this part of the action. Switch 102, which may be a microswitch, has its actuating arm in contact with the moving part of the pneumatic of the predetermined key. Swith 102 is held open by the pneumatic, but closed whenever the key is operated by the pneumatic to sound a note. If, for example, key 34 is being actuated to silence the chimes for the night, then the actuator of switch 102 would be placed underneath the pneumatic of that key, and would perform the function described for switch 35 in the description of FIG. 5.

The invention has been described above in connection with an electrically operated player (or reproducing) piano in which a perforated role carries prerecorded tone signals for operating the action of the piano and for providing special control signals. It will be understood by those skilled in the art that the invention can also be used with other musical instruments, whether operated by a perforated roll, by prerecorded signals on a magnetic tape or disc, or by some other recording medium.

What is claimed is:

1. A modified player piano which is enabled, without significant structural alteration of the original player piano structure, to strike notes which represent the hour of the day, the modified player piano comprising:

record means for operating the piano, the record means providing a sequence of pre-recorded tone signals for causing the piano to strike notes which announce the hour, the sequence comprising a first group of one or more tone signals for striking a first hour, a second group of one or more tone signals for striking a second hour, and a predetermined tone signal, located between the first and second groups of tone signals, the predetermined tone signal corresponding to a note which is different from the notes which are struck by the tone signals in the first and second groups;

electric motor means providing power for moving the record means along a predetermined path;

sensor means adjacent to the predetermined path, the sensor means responding to the passage of each tone signal, including the predetermined tone signal, to provide a corresponding control signal;

action means comprising a plurality of cooperating elements which move in response to the predetermined control signal to strike a predetermined note;

switch means connecting the motor means to a source of electricity, the switch means responsive to one of a movement of the action means and the predetermined control signal to disconnect the motor means from the source of electricity, the switch means responsive to a switch signal to reconnect the switch means; and timing means for supplying the switch signal to the switch means at a predetermined time.

2. The modified player piano of claim 1 in which the piano further comprises a keyboard having a plurality of keys each of which moves when the respective action means responds to a control signal, the modified player piano further comprising;

support means positioning the switch means over the keyboard; and actuator means extending from the switch means into contact with that piano key which responds to the predetermined note, whereby, when the action means responds to a predetermined control signal, movement of that piano key results in disconnection of the motor means.

3. The modified player piano of claim 2 in which the switch actuating means further comprises means for maintaining the predetermined key in a partially depressed condition, whereby further downward travel of the key is limited and the sound produced when the key is actuated is suppressed or substantially reduced.

4. The modified player piano of claim 3 in which the means for maintaining the predetermined key in a partly depressed condition further comprises:

means for adjusting the amount by which the predetermined key is depressed while permitting sufficient travel of the actuator means to actuate the switching means.

5. The player piano of claim 1 in which the sensor means has pneumatic control signals as outputs and in which the switch means responds to a predetermined pneumatic control signal.

6. The player piano of claim 1 in which the control signal outputs of the sensor means, including the predetermined control signal, are pneumatic, and in which the action means and the switch means respectively respond to pneumatic control signals, and further comprising:

valve means responsive to a valve control signal for selectively connecting the predetermined pneumatic control signal to the action means or to the switch means; and chime-normal control means for controlling the mode of use of the piano, the chime-normal control means providing the valve control signal as an output, whereby sounding of the predetermined note is suppressed when the piano is striking the hour.

7. The modified player piano of claim 1 in which the timing means provides a series of switch signals at predetermined times, the record means further comprises a second predetermined tone signal which occurs at the same time as the first predetermined tone signal, the sensor means provides a second predetermined switch signal, and the action means strikes a second predetermined note in response to the second predetermined control signal, the modified player piano further comprising;

second switch means connected in series with the source of electricity, the switch means, and the motor means, the second switch means responsive to the second control signal to break the series connection and to a second switch signal to make the series connection; and second timing means providing a second switch signal at a second predetermined time, the second predetermined time being longer than the predetermined time, whereby the striking of one or more of the hours is suppressed.

8. The modified player piano of claim 1 in which the first group of tone signals and the predetermined tone signal are spaced apart on the recording to separate any sound resulting from striking of the predetermined key which stops the motor means from the sound of the completed first striking of the hour.

* * * * *